United States Patent [19]

Wondra et al.

[11] Patent Number: 4,597,627

[45] Date of Patent: Jul. 1, 1986

[54] MULTIPLE PLUG

[75] Inventors: Arthur Wondra; Gerhard Weller, both of Erlangen; Alfred Ulrich, Fuerth, all of Fed. Rep. of Germany

[73] Assignee: Siemens Aktiengesellschaft, Berlin & Munich, Fed. Rep. of Germany

[21] Appl. No.: 485,219

[22] Filed: Aug. 4, 1983

Related U.S. Application Data

[63] Continuation of Ser. No. 230,602, Feb. 1, 1981, abandoned.

[30] Foreign Application Priority Data

Mar. 28, 1980 [DE] Fed. Rep. of Germany ..... 3012174

[51] Int. Cl.[4] ..... H01R 33/04

[52] U.S. Cl. ..... 339/196 M; 339/210 M

[58] Field of Search ..... 339/195 A, 196 A, 196 M, 339/198 G, 198 H, 198 P, 198 S, 206, 207, 208, 210

[56] References Cited

U.S. PATENT DOCUMENTS

| | | | |
|---|---|---|---|
| 2,469,397 | 5/1949 | Mezek | 339/196 M |
| 3,273,107 | 9/1966 | Chandler | 339/198 S |
| 3,641,482 | 2/1972 | Bretting | 339/196 M |
| 4,108,526 | 8/1978 | McKee | 339/103 M |
| 4,171,861 | 10/1979 | Hohorst | 339/198 G |

FOREIGN PATENT DOCUMENTS

| | | | |
|---|---|---|---|
| 1952504 | 11/1970 | Fed. Rep. of Germany | 339/198 G |

OTHER PUBLICATIONS

"The Silvon Stress Test ECG Electrode System'-'-NDM Brochure (1977)-6 pages.

"Silvon, Compare it With Your Present Electrode System" NDM Brochure (1978)-6 pages.

"Nouveau Standard A Usage International Faisceaux ECG Electrodes", Prena Brochure-8 pages.

"Adapter und Patientenkabel", ARBO Brochure-6 pages.

*Primary Examiner*—Gil Weidenfeld

*Assistant Examiner*—Gary F. Paumen

*Attorney, Agent, or Firm*—Hill, Van Santen, Steadman & Simpson

[57] ABSTRACT

The invention relates to a multiple signal cable system having a plurality of individual plug heads formed at the free ends of the cables for connection to a corresponding number of counter-piece contacts on a unitary adapter. The present invention permits a simplified manipulation of the multiple plug heads for connection with the adapter, while also affording rearrangement of the sequence of individual plug heads in accordance with the particular adapter. The individual plug heads are connected together in a consolidated, unitary arrangement by means of a housing collar having a sequence of side-by-side chambers for respectively securing the plug heads tightly therein. Lock means are provided on the housing and plug heads to secure the plug heads against relative movement and prevent the individual plug heads from falling out or being withdrawn from the unitary arrangement; however, the lock means are releasable to permit removal or rearrangement of the plug heads as needed.

3 Claims, 4 Drawing Figures

MULTIPLE PLUG

This is a continuation of application Ser. No. 230,602, filed Feb. 1, 1981 abandoned.

BACKGROUND OF THE INVENTION

1. Field of the Invention

The invention relates to attachment means for a plurality of individual plug heads to a corresponding number of counterpiece contacts formed in an adapter plug.

2. The Prior Art

Systems utilizing a plurality of signal cables having individual plug parts for connection with a unitary adapter are well-known. These systems conventionally require the individual plug heads to be individually connected one at a time with corresponding contacts formed on the adapter part. Thus, for example, an NDM brochure entitled "The Silvon Stress Test ECG Electrode System" (1977) discloses a plurality of individual plug heads attached at the free ends of respective signal cables to be individually plugged next to one another in the hollow housing of an adapter which comprises a single multiple cable connection. A similar multiple cable connection adapter is described in the NDM brochure entitled "Silvon, Compare It With Your Present Electrode System" (1978), where the contact housing for acceptance of the individual plug heads is seated in a trough-shaped shoe provided with insertion slots slong a front wall to receive individual plug head ends of respective cables. There, the hollow housing is withdrawn from the bottom trough portion so that the individual plug heads can be individually inserted into the slots for later connection with adapter counter-pieces. The hollow housing is replaced back into the bottom trough and the connections are completed, such that the individual plug heads can no longer be withdrawn through the slots since the diameter of the heads is greater than the width of the slots. This adapter construction provides increased security against inadvertent unplugging of the plug heads. A similar assembly technique is shown in the Prena brochure entitled "Nouveau Standard A Usage International Faisceaux ECG Electrodes", where a clamp, designed in the manner of a comb with slots, is closed over the individual plug heads to secure them against withdrawal from connection with the adapter contacts. There is also known a circular adapter connection shown in the ARBO brochure entitled "Adapter und Patientenkabel" which has an adapter part designed as a shoe having vertical plug holes and a flat bottom part for each individual plug head. In each of the above cases, the individual plug heads must be individually plugged in at their respective adapter connection.

The present invention is drawn to apparatus which simplifies connection manipulation for a multiple cable system to an adapter plug part. The inventive apparatus further affords the greatest possible variability for the combination of individual plug heads arranged for connection to the adapter.

SUMMARY OF THE INVENTION

A plurality of signal cables are provided at their respective free ends with individual plug heads which can be consolidated together into a unitary housing structure in any desired arrangement with respect to one another in accordance with the corresponding arrangement of the poles of contact counterpieces in an adapter. Means are provided which retain the plug heads in the housing, such means being releasable as needed. According to the invention, all of the individual plug heads are initially connected together into the containment housing before attachment to the adapter. The consolidated plug heads are then simultaneously connected as a unit with contact means on the adapter. Thus, the invention simplifies manipulation of a multiple plug system and the individual cables and plug head attachments are more stably arranged over all. The combination or arrangement of plug heads in the housing may be readily changed by simply varying the order of the plug heads in plural carrying chambers formed in the housing to contain the plug heads. Thus, the greatest possible variability for adaptation to different conditions is provided.

DESCRIPTION OF THE PREFERRED EMBODIMENTS

Figure 1:
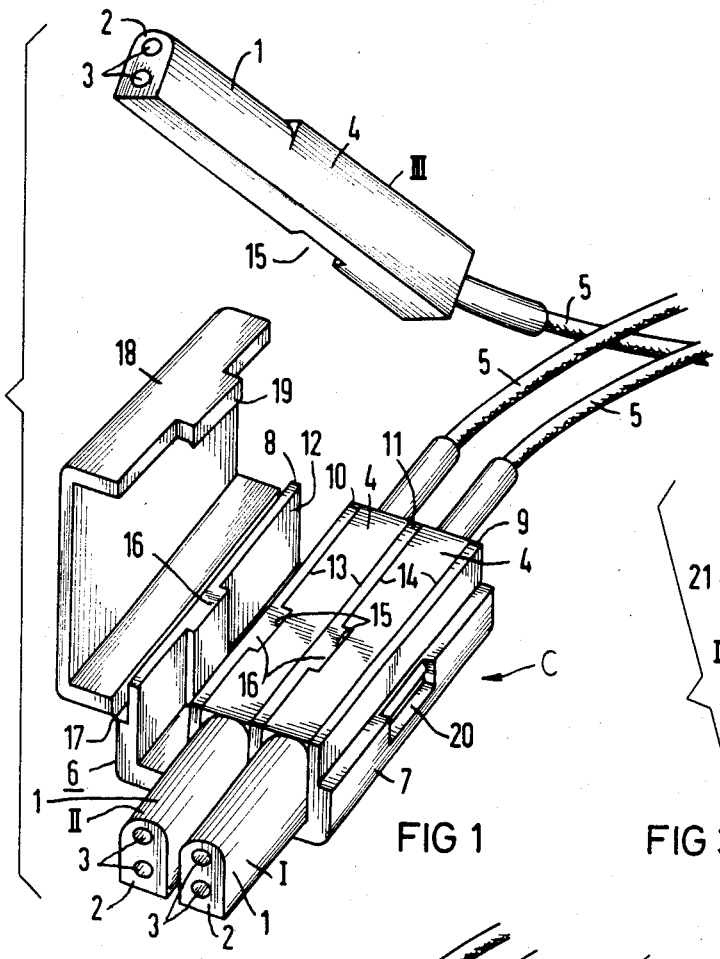
FIG. 1 is a partially exploded perspective view illustrating one embodiment of the invention.

The multiple plug system of the present invention is hereafter described for use with three signal cables, although the invention is adapted to handle any number of plural cables. In FIG. 1, three individual plug heads I, II, and III are shown being placed together in a consolidated arrangement C in accordance with the present invention. Each plug head is shaped generally in the form of a narrow, elongated bar. Each plug head has a head part portion 1, which is rounded off along its top side surface and contains a two-pole socket connection means 3, and a back part 4, which is generally of narrow cube-shaped cross-section. The plug heads are respectively fitted at the free ends of individual signal cables 5, attaching to the back parts of the plug heads.

The plug heads I, II, and III are connected together in side-by-side relation to form the consolidated unit C by means of a containment housing 6, which acts in the manner of a collar. The housing 6 comprises a bottom wall portion 7 having a plurality of parallel extending sidewall partitions 8, 9, 10, and 11 upstanding from the bottom wall. The sidewalls subdivide the housing into a total of three adjacent, parallel chambers 12, 13, and 14. Each of the sidewalls 8, 10, and 11 contains an inwardly facing protuberance portion 16 which is adapted to fit snugly into corresponding side face recesses 15 formed on respective side faces of the plug heads. Thus, a frictional lock means is afforded in the housing chambers for securing the plug heads against relative movement in the housing. Once inserted into the chambers, the plug heads lie tightly due to the frictional engagement of the protuberances 16 in the plug head recesses 15 and in that plug head back portions 4 secured in the chambers fill up or closely conform to the chamber grooves. Thus, no free corners are exposed within the housing where dirt could accumulate and promote contamination.

Figure 2:
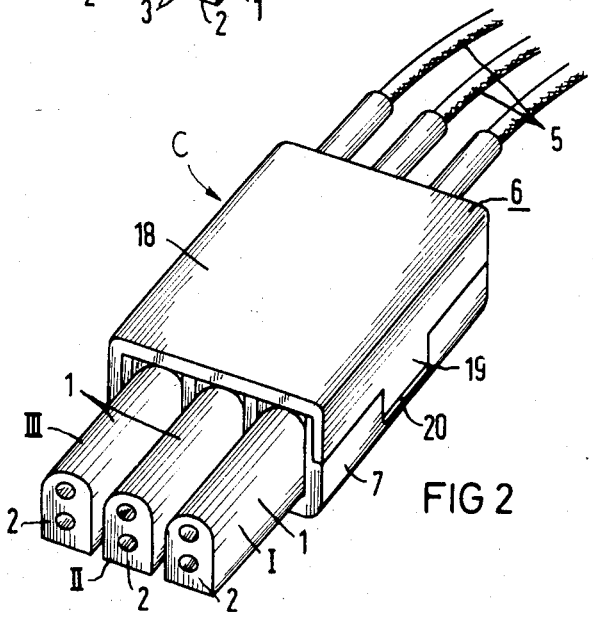
FIG. 2 is a perspective view of the invention shown in FIG. 1 in an assembled condition.

The consolidated arrangement C of the plug heads is made further rigid or stable by means of a cover 18 which is pivotally attached at the end sidewall 8 for movement about a tilting axis 17. The cover 18 comprises a snap projection 19 which fits into a snap groove 20 formed on the opposed end sidewall 9. When the cover is closed, it extends over all the chambers such that the housing 6 forms a collar for the plural plug heads as illustrated in FIG. 2.

Figure 3:
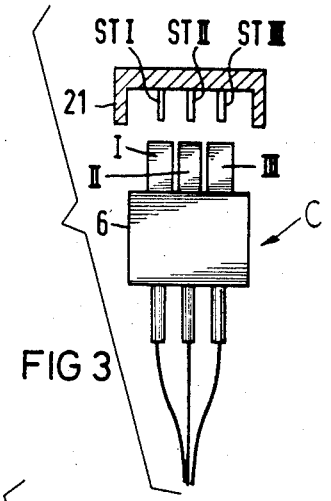
FIG. 3 is a partly schematic plan view illustrating one use of the inventive arrangement.
Figure 4:
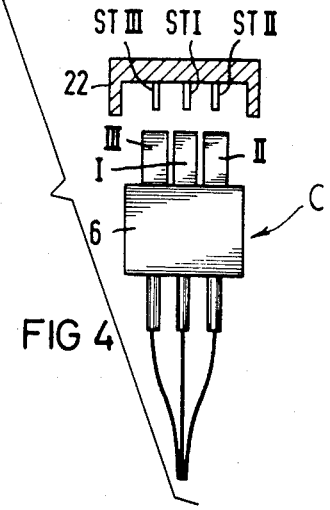
FIG. 4 is a partly schematic plan view illustrating another use of the inventive arrangement.

The consolidated plug arrangement C can now be connected as a unitary component with corresponding contact counter-pieces of an adapter part in a manner affording simple manipulation. Releasability of the plug heads from the housing chambers affords variability in their row arrangement, such that the consolidated arrangement C is adaptable to various conditions. For example, FIG. 3 shows the consolidated plug C containing the individual plug heads I, II, and III in a sorted sequence such that the plug heads fit for connection into contact counter-pieces arranged in the sequence of STI, STII, and STIII on an adapter plug part 21. Given a modified design of the contact sequence in the adapter, the plug heads I, II, and III can be rearranged in the housing collar 6 for corresponding respective adaptation. In addition, when required, individual plug heads can be omitted from the consolidated plug arrangement C or spacer elements interposed within the containment housing. FIG. 4 illustrates, for example, a rearrangement of the counter-pieces with respect to FIG. 3. Accordingly, for an adapter plug piece 22 having counter-contacts arranged in a sequence of STIII, STI, and STIII, the plug heads may be accordingly rearranged within the containment housing for corresponding interconnection with the contacts.

For purposes of the preferred embodiment, the head portions 1 of the plug heads are rounded off along their top surfaces. These head parts 1 are intended to project freely outwardly from the housing collar 6 for connection into the adapter plug. The cube-shaped back part portions 4 are contained within the housing chambers and are so shaped to produce the tight fit relationship described above. The head parts 1 may be shaped differently than shown. The head part shapes are chosen so as to fit the counter-piece connection portion of an adapter in a stable manner.

Thus, the present invention assures, due to the proper sequence of the individual plug heads fixed in the containment housing 6, that the plug heads will fit the sequence of counter-piece contacts at the adapter in a single connection motion. The special shaping of the head parts 1 of the individual plug heads also excludes the possibility of an erroneous connection along the row of plug heads, for example due to an inadvertent 180° rotation. It is further within the contemplation of the present invention that the poles of the individual plug heads or of the counter-piece contacts may be formed in the manner of a single-pole plug connection.

Although various minor modifications may be suggested by those versed in the art, it should be understood that we wish to embody within the scope of the patent warranted hereon all such modifications as reasonably and properly come within the scope of our contribution to the art.

We claim as our invention:

1. Apparatus connecting a plurality of individual, separate signal cables to an adapter having multiple contact means comprising individual plug heads fitted respectively at corresponding free ends of said signal cables and adapted to be connected to corresponding individual counterpieces of said multiple contact means, each respective corresponding plug head and signal cable forming an individual cable unit, said plug heads having pole portions for releasably connecting with corresponding individual counterpieces of said multiple contact means, a containment housing having bottom wall and upstanding sidewall portions defining a plurality of parallel, side-by-side chambers for separately, selectively containing said plug heads, said sidewall portions extending through said housing in the longitudinal direction, wherein each said plug head is shaped as a generally elongated bar having a head part and a back part, each said back part being generally of a rectangularly shaped cross-section for seating between adjacent sidewall portions of said chambers in tight-fit relation, said pole portions being contained in said containment housing such that said pole portions project outwardly from said containment housing, lock means for releasably securing said plug heads in said chambers including a protuberance extending transversely inward of each chamber from at least one sidewall portion thereof and a transverse recess formed on each plug head for respectively matingly fitting said protuberances, whereby said plug heads are contained in said containment housing as a consolidated unit for simultaneous connection with said multiple contact means, pivotal cover means associated with said containment housing for closing said plug heads in said chambers, and releasable clamp means for securing said cover means closed over said chambers, such that upon releasing said clamp means and pivoting said cover means said plug heads are individually removable from said chambers and the relative position of each said cable unit is individually selectable within said containment housing for connection to said adapter.

2. The apparatus of claim 1, wherein said head parts are shaped in cross-section to permit connection of said pole portions and counter-pieces on said adapter.

3. The apparatus of claim 2, wherein each said head part is rounded off at along at least one side surface.

* * * * *